United States Patent [19]

Schneider

[11] 4,190,304

[45] Feb. 26, 1980

[54] APPARATUS FOR USE IN THE CONSTRUCTION AND DECORATION OF UPHOLSTERED FURNITURE AND THE LIKE

[76] Inventor: Robert J. Schneider, 479 Geneva Rd., Glen Ellyn, Ill. 60137

[21] Appl. No.: 904,551

[22] Filed: May 10, 1978

Related U.S. Application Data

[63] Continuation of Ser. No. 728,429, Sep. 30, 1976, abandoned, which is a continuation-in-part of Ser. No. 581,757, May 29, 1975, abandoned.

[51] Int. Cl.[2] ..... A47B 95/04

[52] U.S. Cl. ..... 312/204; 52/311

[58] Field of Search ..... 85/10 E, 53; 52/585, 52/311; 5/353.7; 29/91.4; 312/204

[56] References Cited

U.S. PATENT DOCUMENTS

| | | | |
|---|---|---|---|
| 513,061 | 1/1894 | Slater | 312/204 |
| 2,826,906 | 3/1958 | Rice | 52/585 |
| 3,122,051 | 2/1964 | Greene | 85/53 |
| 3,343,301 | 9/1967 | Adelman | 52/585 |
| 3,490,329 | 1/1970 | Pratorius | 85/10 E |

FOREIGN PATENT DOCUMENTS

| | | | |
|---|---|---|---|
| 184524 | 5/1955 | Austria | 85/10 E |

*Primary Examiner*—James L. Ridgill, Jr.

*Attorney, Agent, or Firm*—Merriam, Marshall & Bicknell

[57] ABSTRACT

This disclosure deals with apparatus for use with articles such as upholstered furniture and the like. The apparatus may serve both a decorative function and a structural function. The apparatus includes trim units or modules which are fastened in place on an article by decorative nails. Each unit includes joining portions which couple with complementary joining portions of other units. Each unit further includes a decorative portion which is integral with the joining portions. A series of units are arranged on an article with their joining portions in contact, and the units are nailed to the article. The units may be designed to facilitate driving of the nails by a power tool. The apparatus may further include specially designed nails which are usable with or without the units, and which facilitate the use of powered nail driving tools.

20 Claims, 38 Drawing Figures

APPARATUS FOR USE IN THE CONSTRUCTION AND DECORATION OF UPHOLSTERED FURNITURE AND THE LIKE

This patent application is a Continuation of pending U.S. patent application Ser. No. 728,429, filed Sept. 30, 1976, now abandoned which is a Continuation-In-Part of U.S. patent application Ser. No. 581,757, filed May 29, 1975, now abandoned.

Upholstery nails have long been used on upholstered furniture. Originally such nails were used to fasten the edges of the upholstery material to the wooden frame, but eventually the heads of the nails were given a decorative design and the nailheads were made part of the design or style of the furniture. Such decorative nails were thus given both a decorative function and a structural function. Such nails have also been applied to furniture, cabinetry, wall paneling, etc. purely for their decorative function.

The use of such decorative nails has become quite expensive in recent years. The nails are expensive to fabricate, and the cost of the labor required to install the nails is also of course substantial. Power tools have been developed for driving the nails, but they too are expensive and they have difficulty driving the nails straight. The large heads of such nails frequently results in the nails becoming tilted in the muzzle of the tool, and when such a tilted nail is driven, it can easily damage the upholstery material.

It is a general object of the present invention to provide improved apparatus for avoiding the foregoing problems.

Apparatus in accordance with the present invention comprises trim units adapted to be combined and fastened to an article. Each trim unit comprises a plurality of joining portions and a decorative portion which connects the joining portions. The joining portions have configurations which mate with or are complementary to the joining portions of other units, whereby a series of units may be arranged with the joining portions together and fastened to the article. The joining portions are preferably formed with nail receiving holes which are shaped to straighten out and guide a nail being driven.

Apparatus in accordance with the present invention further comprises decorative nails constructed to facilitate their use with power tools.

The foregoing and other objects and advantages of the present invention will become more apparent from the following detailed description taken in conjunction with the accompanying figures of the drawings, wherein.

Figures 1, 2, 3, 4, 5, 6, 7, 8, 9, 10, 11, 12, 13, 14, 15, 16, 17, 18, 19, 20, 21, 22, 23, 24:
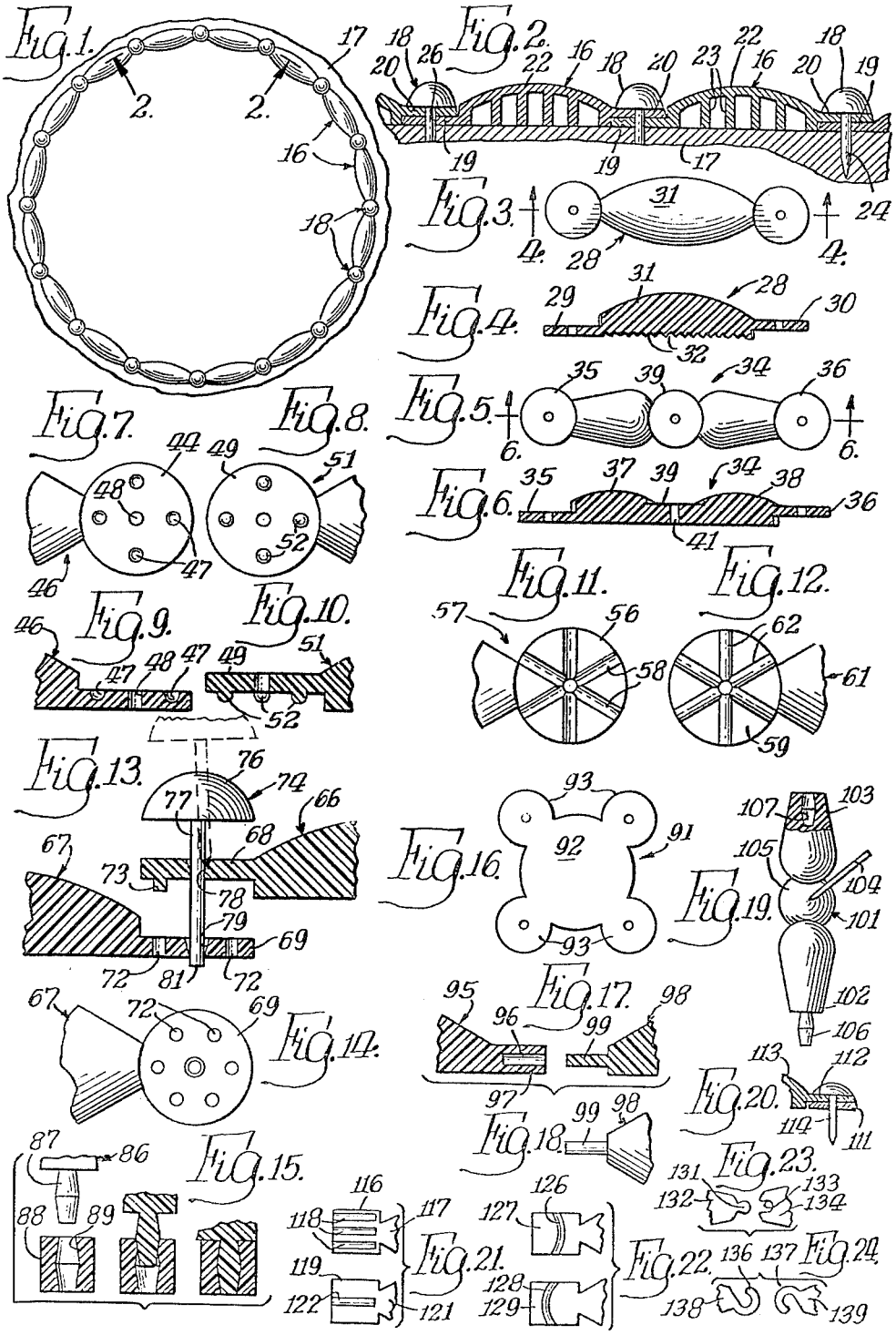
FIG. 1 shows structure including trim units embodying the invention.
FIG. 2 is an enlarged fragmentary view taken on the line 2—2 of FIG. 1.
FIG. 3 is an elevational view of another form of trim unit.
FIG. 4 is a sectional view taken on line 4—4 of FIG. 3.
FIGS. 5 and 6 are views similar to FIGS. 3 and 4 but illustrate another form of the invention.
FIGS. 7 through 10 are views illustrating still another form of the invention.
FIGS. 11 and 12 are views similar to FIGS. 7 and 8 but illustrating still another form of the invention.
FIGS. 13 and 14 are views illustrating still another form of the invention.
FIG. 15 is a sequence of views illustrating still another form of the invention.
FIG. 16 is an elevational view illustrating still another form of the invention.
FIGS. 17 and 18 are views illustrating still another form of the invention.
FIG. 19 is a view illustrating still another form of the invention.
FIG. 20 is a fragmentary view illustrating still another form of the invention.
FIG. 21 is a view illustrating still another form of the invention.
FIG. 22 is a view similar to FIG. 21 and illustrates still another form of the invention.
FIG. 23 is a view illustrating still another form of the invention.
FIG. 24 is a view illustrating still another form of the invention.

FIG. 1 illustrates a design formed by 16 units which are positioned end-to-end to form a circle. The units 16 are fastened to an article 17 being decorated, by eighteen nails, only the heads of the nails 18 appearing in FIG. 1.

With reference to FIG. 2, a plurality of the units 16 are illustrated, and one nail 18 is shown at each end of each of the units 16. Each unit 16 comprises two joining portions 19 and 20 at the ends thereof, and a decorative portion 22 which connects the two joining portions 19 and 20. The joining portion 19 of each of the units 16 lies flat against the surface of the article 17, whereas the joining portion 20 is raised or spaced from the surface of the article 17 by a distance which is equal to the thickness of the portion 19. Consequently, the portion 20 of one unit 16 may be positioned over the top of the portion 19 of the next adjacent unit 16, and the shank 24 of a nail 18 is positioned through aligned holes 26 formed through the portions 19 and 20 and driven into an article.

The portions 19 and 20 are substantially circular and have a diameter approximately equal to the diameter of the head of the nail 18. When the diameters are equal as shown in FIG. 1, the head of the nail 18 overlies the portions 19 and 20 and only the head of the nail 18 appears to an observer. The diameters of the portions 19 and 20 could instead be made less than or equal to that of the nail heads, or the nail head could be substantially smaller than the diameter of the portions 19 and 20. The nail head is curved, and the edges of the portions 19 and 20 may be shaped as shown in FIG. 2 so that they appear to be a continuation of the nail head.

The decorative portion 16 may have any desired configuration or design. In the form illustrated in FIGS. 1 and 2, the decorative portions 22 are elongated in the direction of the circumferences of the circle, and the upper or outer surface of each portion 22 is curved or domed as shown in FIG. 2. To strengthen the portion 22, a plurality of ribs 23 may be formed on the underside thereof. The ribs 23 could be arranged to extend lengthwise of the portion 22 instead of crosswise as illustrated, or the ribs could be eliminated entirely. If the unit 16 were made of a flexible plastic and with crosswise ribs 23 as illustrated in the drawings, the ribs would enable the unit 16 to be bent slightly over a curved surface of an article 17 and the ribs would grip the article.

The underside or backside of a unit as disclosed herein engages the article being decorated and is normally hidden, while the upper or outer surface includes a design and is the normally viewed side.

The units 16, and the other forms of the units disclosed herein, may be formed in any style, shape or color, and they may be made, as by molding, casting or stamping, of plastic, metal or any other desired material. The article 17 may be a piece of upholstered furniture, a cabinet, wall paneling, or any other article to be decorated.

If the unit 16 were made of stamped sheet metal, it may be designed to be substantially bendable to conform to a curved surface. A trim unit, such as the unit 16 or 28 (FIG. 4), made of a cast material such as metal as mentioned above, may include thinner or weaker sections as illustrated by the cross sections of FIGS. 2 and 4 to make it more easily bendable.

As shown in FIG. 2, the portion 19 is complementary to or mates with the portion 20 of the next adjacent unit. Each of the units 16 may be made identical and they may be coupled together to form an attractive design as shown in FIG. 1. Of course, the units 16 are not limited to use in making a circular design but may be made to form any design desired. Instead of using nails 18 the units may be designed and manufactured without the holes 26, and fastened to the article 17 using an adhesive or using pinnails which may be driven through the units without the need for a preformed hole.

FIGS. 3 and 4 illustrate a unit 28 having a slightly different construction. The unit 28 also includes joining portions 29 and 30 at its opposite ends, and a decorative portion 31 which connects the two joining portions 29 and 30. The portions 29 and 30 are of course complementary to or mate with joining portions of similarly constructed units. The decorative portion 31 of the unit 28 is made solid, and serrations 32 are formed on the underside of the portion 31 so that the unit 28 will tend to grip an article to which it is attached. The serrations 32 also enable the unit to be bent slightly to conform to a curved surface of an article to which the unit is attached.

FIGS. 5 and 6 illustrate another form of unit 34, wherein joining portions 35 and 36 are formed at the opposite ends of the unit. As is best shown in FIG. 5, the portion 35 lies flat against an article to which the unit 34 is to be attached, and the portion 36 is spaced above the surface so that it can be mated or coupled with a portion 35 of another unit. The unit 34 includes two decorative portions 37 and 38 which are adjacent the joining portions 35 and 36, respectively. A center part 39 of the unit 34 connects the two decorative portions 37 and 38, the portion 39 having a hole 41 at the center thereof. The center part 39 is circular and has a diameter substantially equal to that of the two portions 35 and 36 and its upper surface is substantially at the same level as the upper surface of the portion 36. The unit 34 is of course designed to be fastened to an article to be decorated by fastening three nails at the portions 35, 36 and 39, and the nail heads will all be at the same height.

When fastening a series of the units described herein to an article to be decorated, the decorator simply positions the joining portions of the units in connection with each other and nails the units in place, either by hand or using a power tool, and at the same time the decorator angularly orientates the units to form the desired design. To assist in orienting one unit relative to another and to hold the units in a selected oriented position relative to each other, orientation means may be formed on the joining portions of the units.

With reference to FIGS. 7 and 9, a joining portion 44 of a unit 46 has a plurality of detents or dimples 47 formed in the upper surface thereof, the detents 47 being angularly displaced and located relatively close to the outer periphery of the joining portion 44. As shown in FIG. 9, detents 47 are relatively shallow and are curved. A hole 48 may also be formed at the center of the joining portion 44 for use in securing the unit 46 in place. FIGS. 8 and 10 illustrate a complementary or mating portion 49 of a unit 51. The portion 49 has a plurality of rounded knobs or projections 52 formed on one surface thereof, the knobs 52 being best shown in FIG. 10. The two joining portions 44 and 49 are coupled together by positioning the knobs 52 in the detents 47, and then fastening the units 46 and 51 in place. Since, in the embodiment illustrated in FIGS. 7 through 10, there are four regularly spaced detents 47 and knobs 52, there are a plurality of angular positions possible between the two units 46 and 51. While an equal number of knobs 52 and detents 47 are illustrated, it will be apparent that a plurality of detents 47 may be provided on the unit 46 but only one knob 52 on the unit 51, and such a construction will accomplish the same function of orienting the two units 46 and 51. While holding the two nailholes 48 of the two portions 44 and 49 in alignment, the portions 44 and 49 may be angularly oriented.

Even though there are four detents in the joining portion 44 as shown in FIGS. 7 and 8, the two units 46 and 51 would actually have only three possible angular positions relative to each other because the presence of the decorative portions of the two units would prevent the units from being placed in one of the four positions.

FIGS. 11 and 12 illustrate another form of orientation means. In FIG. 12, a joining portion 56 of a unit 57 is illustrated, the portion 56 having a plurality of angularly displaced radially extending grooves 58 formed therein. In the joining portion 59 of the complimentary unit 61, a plurality of radially extending, angularly spaced ribs 62 are formed thereon, the ribs 62 being shaped so that they can be positioned in the grooves 58. The angular spacing of the ribs 62 is the same as that of the grooves 58, with the result that the unit 61 has a plurality of different angular positions relative to the unit 57. Of course, only one rib 62 could be provided on the unit 61, and the single rib could be positioned in a selected groove 58.

FIGS. 13 and 14 illustrate another form of orientation means which is somewhat similar to that illustrated in FIGS. 7 through 10. With reference to FIGS. 13 and 14, two units 66 and 67 are illustrated, and the two units include joining portions 68 and 69 respectively. The joining portion 69 of the unit 67 has a plurality of angularly displaced holes 72 formed therethrough, and the joining portion 68 of the unit 66 has a single projection 73 formed thereon. In the arrangement illustrated, the joining portion 69 has a total of six holes 72, and consequently, the projection 73 may be positioned in any of the holes with the exception of those which would result in the decorative portions of the two units 66 and 67 overlying each other.

The two units 66 and 67 are designed to be fastened to an article (not shown) by a nail 74 including a head 76 and a shank 77. The shank 77 is positioned in holes 78 and 79 in the portions 68 and 69. The nail 74 is a type which is designed to be driven by a power tool, and for this reason, the end 81 of the shank 77 is blunt to reduce the chance that the nail will cause the tool to malfunction. To assist the tool operator in driving the nail 74 straight into the article, through the holes 78 and 79, the hole 78 is made with a funnel shape and the hole 79 is made with a cone shape, such shapes serving to guide the nail. Of course, both the holes could have a funnel shape or both could have a cone shape if desired. This design may also be used when the nails are manually driven, rather than power tool driven. Obviously the slanted or bevelled surfaces of the conical or funneled designs, or similarly effective designs, will deflect and guide the driving of an improperly manually positioned nail of normal or special point, as well as deflecting and guiding specialty pointed or tilted normal type power tool driven nails. In FIG. 13 a nail in tilted position is shown by the dotted lines. Also, where power tool driven nails are of a type which are bonded together in strips and magazine fed in the power tool, the free spaces provided by these designs around the shank of the driven nail could serve as receptacle points for residue of such bonding material, and thereby reduce the possibility that such bonding material residue could damage work material or impede the flush driving of the nail. Obviously whether the slanted or bevelled surfaces of such designs are designed and formed as a flaring of the vertical walls of the nailhole, or as a depressing or indenting of the normally horizontal surface of any portion of the trim unit, the resulting guidance functions, etc., are the same and similarly established. Of course, the extent or scope of the flaring or bevelling could vary in accordance with the design characteristics of varying trim units.

FIG. 15 illustrates another form of orientation means which is somewhat similar to that shown in FIGS. 13 and 14. A unit 86 includes a projection 87 which performs the function of the projection 73. The joining portion 88 of a complementary unit includes a hole 89 therein which has a shape corresponding to that of the projection 87. The projection 87 has an enlarged width at the center thereof, and the opening 79 is also enlarged near the center thereof. The units are made of a resilient material that is capable of expansion or stretching, and consequently when force is applied to press the projection 87 into the hole 89 as illustrated by the sequence of views in FIG. 15, the projection 87 and the hole 89 are deformed until the center enlarged portion of the projection 87 snaps into the center area of the hole 89. Thereafter, the projection 87 is locked in the hole 89 and the two joining portions are held together. Such an arrangement makes it easier for a designer to arrange the units and, after arrangement, to fasten them to an article to be decorated. The parts of the units which are not illustrated in FIG. 15 are similar to those previously described.

FIG. 16 illustrates another form of unit 91 which includes one decorative portion 92 and four joining portions 93. This form is illustrated to show that more than two joining portions may be provided. The unit 91 may be used in conjunction with a plurality of units of the character shown in FIGS. 2 through 4, for example, or a plurality of identical units 91 may be employed together. All of the joining portions 93 of the unit 91 may have the same configuration, or some of the joining portions may have one configuration and other portions may have complementary configurations.

FIGS. 17 and 18 illustrate still another form of decorative unit. In the arrangement of FIGS. 17 and 18, one end of a unit 95 has a slot 96 formed in the joining portion 97 thereof, and the complementary or mating joining portion of another unit 98 has a tongue 99 formed thereon. The tongue 99 and the slot 96 are located so that, when the bottom surfaces of the two units are positioned flat against an article to be decorated, the tongue 99 is in line with the slot 96 and it is sized so that it may be pushed into the slot 96. The frictional engagement between the tongue 99 and the walls of the slot 96 is sufficient to bind the two units together. After the units have been positioned against an article to be decorated, a pinnail may be driven through the joining portions or through some other part of the two units in order to firmly secure them together and to the article being decorated, or an adhesive may be used.

FIG. 19 illustrates still another form of unit. In this form, the ends of a unit 101 have complementary interengaging joining portions 102 and 103. At the center of the unit 91 is a circular domed area 105 and a pinnail 104 may be driven through the area 105 or some other part of the unit when nailing the unit 101 to an article being decorated. The joining portions 102 and 103 consist of a longitudinally extending projection 106 formed at one end thereof, and an opening 107 formed at the opposite end thereof. The projection 106 is enlarged at its center area and the hole or opening 107 is similarly shaped, so that the projection 106 may be snapped into a hole 107 of another unit (not shown) which is identical with the unit 101 by pressing the projection 106 into the opening 107 of the adjacent unit. Of course, the unit 101 and the other identical units must be made of a material such as a type of plastic which has some resiliency so that the projection 106 and the wall of the opening 107 may deform slightly when they are being snapped together.

In some designs utilizing units as shown in FIGS. 1 to 6, the units will not close as in a circle but the ends will be open as at the ends of a straight line. To make the ends uniform in appearance with the rest of the design, spacers 111 (FIG. 20) may be used. In the case where the endmost joining portion 112 of a unit 113 is spaced from the surface of an article (not shown), the spacer 111 is positioned underneath the joining portion 112. At the other end of the design where the endmost joining portion (not illustrated) lies flat against the article a spacer similar to the spacer 111 is preferably provided on top of the joining portion. Thus, all of the nail heads will have the same height and a uniform appearance will be presented.

FIG. 20 also illustrates that the nail head, the joining portions and the spacer may be shaped to present a continuous curved appearance. The head of a nail 114 is curved or domed, and the edges of the joining portion 112 and the spacer 111 are similarly curved. This same design is also illustrated in FIG. 2 where mating joining portions and the nail heads are similarly shaped with continuous curves.

Of course, instead of the continuous curves shown in FIGS. 2 and 20, the arrangement shown in FIG. 13 may be used where the nail head completely covers the joining portions, or an arrangement may be used where the nail head is substantially smaller than the joining portions.

FIG. 21 shows a construction where the joining portions are square rather than round, and they may be laterally offset. A joining portion 116 of a unit 117 has a plurality of spaced grooves 118 formed therein, and the joining portion 119 of a complementary unit 121 has a rib 122 formed thereon. The rib 122 may be positioned in one of the grooves 118 in order to hold the portions together while the units are being attached to an article by pinnails or an adhesive.

The grooves 118 and the rib 122 could be arranged to extend laterally of the units instead of longitudinally as illustrated, or they could extend at an intermediate angle.

FIG. 22 shows a construction where a curved groove 126 is formed in a joining portion 127, and a similarly curved rib 128 is formed in a joining portion 129. The rib 128 may, of course, be positioned in the groove 126, and permits the units to be angularly oriented.

In the above described forms of the invention, the complementary joining portions are such that one covers or encloses the other when they are connected together. It is possible, as shown in FIGS. 23 and 24, for both of the joining portions to be fully exposed after connection. In these forms the two joining portions are complementary in the sense that they may be connected together and also in an artistic sense because the two joining portions produce a pleasing appearance.

In FIG. 23, a dovetail configuration is provided by a tenon 131 formed on one unit 132, and a mortise 133 formed on another unit 134. The corners of the two units are rounded so that the two units may be pivoted or angularly oriented, similar to a ball and a socket arrangement.

In FIG. 24, hooks 136 and 137 are respectively formed on two units 138 and 139. The two hooks 136 and 137 are interengageable, and they permit the two units to pivot relative to each other.

Figure 25:
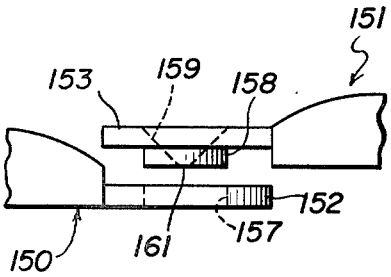
FIG. 25 is a view illustrating still another form of the invention.
Figure 26:
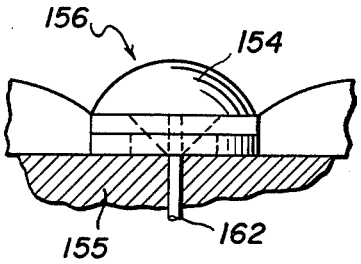
FIG. 26 is another view of the form shown in FIG. 25 but showing the parts assembled.

FIGS. 25 and 26 illustrate a construction somewhat similar to FIGS. 13 and 14 but wherein the combined lengths of the nailholes 78 and 79 in the joining portions 68 and 69 are combined in a single nailhole. FIGS. 15 and 16 illustrate two units 150 and 151 having joining portions 152 and 153. The portion 152 is designed to lie flat against an article 155 and the portion 153 is designed to fit on top of the portion 152. The portions 152 and 153 are preferably circular and have a diameter substantially equal to that of the head 154 of a decorative nail 156, similar to the units shown in FIGS. 13 and 14.

The lower portion 152 has a relatively large, centrally located, circular hole 157 formed therein, and the upper portion 153 has a circular downwardly extending projection 158 formed thereon. The projection 158 is designed to fit snugly in the hole 157 as shown in FIG. 26, and such interengagement enables the units to be pivoted relative to each other on the axis or center of the hole 157. An inverted cone-shaped opening 159 is formed in the portion 153, and the apex of the opening forms a nail hole 161 at the bottom surface of the projection 158. As shown in FIG. 26, the shank 162 of the nail 156 extends through the hole 161. The diameter of the opening 159 at the upper surface of the portion 153 is made as large as possible while keeping the opening 159 within the confines of the projection 158.

The shape and size of the opening 159 serve to guide the point or lower end of the shank 162 into the hole 161, similarly to the function of the holes 77 and 79 (FIGS. 13 and 14). This is particularly advantageous when a power tool is employed to drive the nail 156, because even though the shank 162 may be tilted in the muzzle of the tool, the size and shape of the opening 159 will straighten out the nail.

Figure 27:
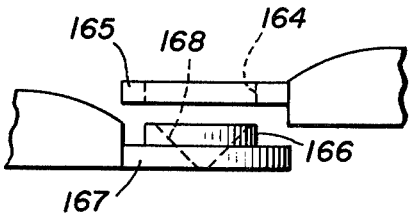
FIG. 27 is a view similar to FIG. 25 but showing another form of the invention.

FIG. 27 shows an arrangement similar to that of FIG. 25 but wherein the large circular hole 164 is formed in an upper joining portion 165 and an upwardly extending projection 166 is formed on a lower joining portion 167. The projection 166 fits in the hole 164, and a relatively large inverted cone-shaped opening 168 is formed in the upper side of the projection 166. The functioning of the FIG. 27 construction is otherwise the same as that shown in FIGS. 25 and 26.

To assist in guiding the end of the nail to the nail hole at the apex of the cone-shaped opening, a plurality of grooves leading to the nail hole may be provided. In FIG. 26, a unit 171 is provided which is generally similar to the unit 151. A cone-shaped opening 172 is formed in the joining portion, and the opening 172 has a plurality of grooves 173 formed therein, running from the upper surface of the joining portion downwardly to a nail hole 174. The grooves 173 form a star-like configuration and they guide the end of a tilted nail directly to the nail hole 174.

Figure 29:
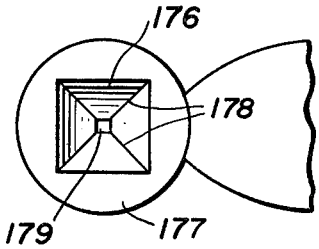

FIG. 29 illustrates a similar arrangement except that the opening 176 in a joining portion 177 is in the shape of an inverted pyramid, which in this instance has four sides. The corners of the pyramid form grooves 178 which direct the end of a nail to a nail hole 179.

Figure 30:
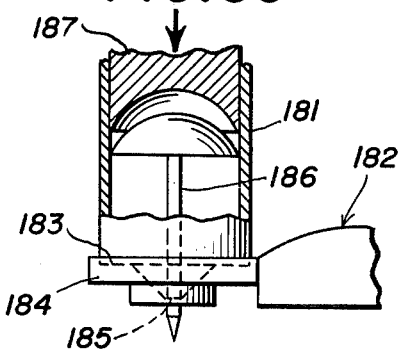
FIGS. 30 and 31 are views partially in section of other forms of the invention, used with a power tool.

FIG. 30 shows an arrangement for spotting or locating the muzzle 181 of a nail-driving power tool. A unit 182 is provided having a construction like that of the unit 151 except that a shallow circular recess 183 is formed in the upper surface of a joining portion 184. The recess 183 is concentric with a nail hole 185, and its diameter is slightly larger than the outer diameter of the muzzle 181 so that the end of the muzzle 181 will fit snugly in the recess 183. A nail 186 is shown in the muzzle 181, and a ram 187 is shown above the head of the nail. The tool operator uses the recess to position the muzzle 181, and he then triggers the tool to drive the nail.

Figure 31:
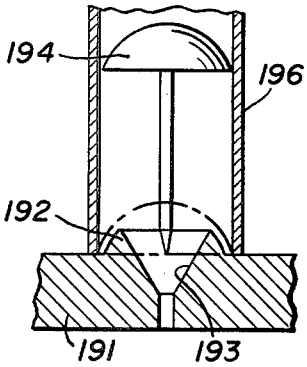

When using a nail having an internally hollow domed head, an upward projection may be used to spot the muzzle. In FIG. 31, a joining portion 191, or other part of a trim unit, is provided with a circular upward projection 192. A large funnel shaped opening 193 is formed in the projection 192 and the portion 191. The opening 193 is concentric with and slightly smaller than the projection 192, and the outer diameter of the projection 192 is slightly less than the internal diameter of the head 194 of a nail. The muzzle 196 is positioned over the projection 192, and when the nail has been driven the head completely covers the projection and the lower edge of the head lies flat against the surface of the portion 192.

Figure 32:
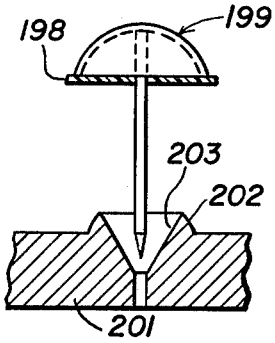
FIGS. 32 and 33 are views of another form of the invention.
Figure 33:
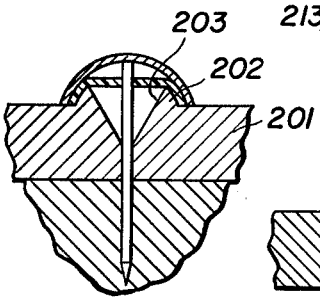

The structure shown in FIGS. 32 and 33 is somewhat similar to that of FIG. 31. Nails having a hollow domed head may be supplied on a tape and fed into a power tool. The tape, which may be a thin plastic, consists of a series of circular segments which are connected by short tabs or links. The numeral 198 designates a circular segment fastened to the shank of a nail 199, the segment 198 having a slightly larger diameter than the head 200 of the nail. A trim unit 201 has a projection 202 and a funnel-shaped opening 203 similar to the unit 192. The diameter of the projection 202 is smaller than the internal diameter of the nail head by an amount approximately equal to twice the thickness of the segment 198. The projection 202 need not of course be a continuous ridge around the opening 203, since a single short projection or a series of angularly spaced projections would serve the same function. The projection is used for spotting a power tool and the shape of the opening 203 guides the nail. The projection 202 also neatly tucks the segment 198 into the hollow interior of the nailhead, as shown in FIG. 33, so that it cannot be seen.

Figure 28:
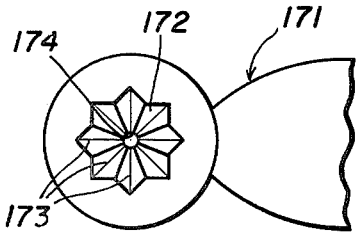
FIGS. 28 and 29 are elevational views of still other forms of the invention.
Figure 34:
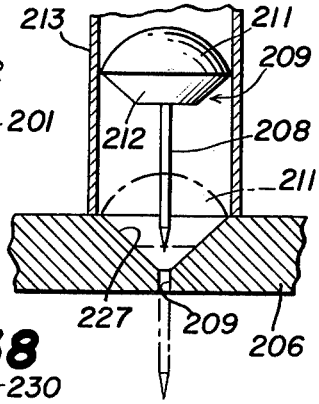
FIG. 34 is a view of another form of the invention used with a power tool.

In FIG. 34, a unit 206 is provided having a large funnel-shaped opening 207 which guides the shank 208 of a nail 209 to a nail hole 210 as previously explained. The opening 207 may have grooves formed therein as shown in FIGS. 28 and 29, and this is also true of course of the openings of the units shown in FIGS. 25 to 27, 30 to 33 and 35. When a unit is provided having a large cone or funnel-shaped opening as illustrated, the nail 209 may have a large molded head 211 made of plastic for example. The underside of the head 211 has an inverted truncated cone-shaped portion 212 which is sized to be received in the opening 207. Such an enlarged head 211 gives added strength and provides added guidance and proper seating of the nail when driven either by hand or by a tool having a muzzle 213. The cone-shaped portion 212 is preferably undersized relative to the opening 207, as shown, to provide clearance for dirt or foreign matter or to allow for tolerances.

Some power tools used in factories to drive nails include flexible feed tubes made of plastic or rubber, which conduct the nails to the muzzles of the tools. Such a tool has been used in the past with normal nails having relatively small heads, and few feeding problems have been encountered because such nail heads are not large enough in diameter relative to the diameter of the shank, to permit the nails to tilt excessively in the feed tube. However, when such a tool is used with a nail as shown in FIG. 13 or in FIG. 30, for example, the large diameter nail head enables the nail to tilt in the feed tube to the extent that the nail point rubs against the inner surface of the tube and may catch on the tube. This results in rapid wear on the tube. Nails of the designs shown in FIGS. 35 to 38 eliminate this problem.

Figure 35:
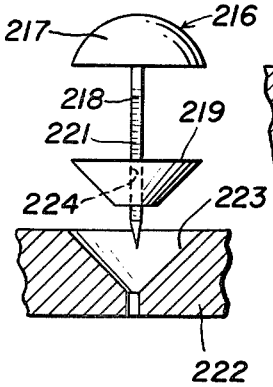
FIGS. 35 and 36 are views of another form of the invention.
Figure 36:
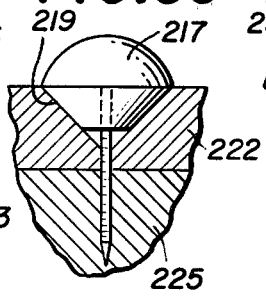

FIGS. 35 and 36 show a nail 216 having a head 217 and a shank 218. Adjacent the lower end of the shank 218 is fastened a guide 219 having, in this instance, an inverted cone shape. The guide 219 may be made, for example, of plastic, and it could be molded on the shank 218. To prevent the guide 219 from falling off the shank 218, circular or longitudinal ridges or serrations 221 may be formed on the shank 218. The nail 216 is designed for use with a unit 222 having an inverted funnel-shaped opening 223 which straightens out a tilted nail as previously explained. The guide 219 is sized to be received in the opening 223, and it may be slightly undersized relative to the opening 223 to provide clearance for dirt or other foreign matter. When the nail 216 is driven, the guide 219 seats in the opening 223, and the shank 218 then slides through the nail receiving hole 224 as the nail is driven into an article 225.

The outer diameters of the nail head 217 and the guide 219 are substantially equal and are sized to slide in the feed tube and the muzzle (not shown) of the tool. The head and the guide serve to prevent the nail 216 from tilting in the feed tube and causing wear as explained. Such a nail may also be used in a power tool designed to drive cylindrical dowels because the head 217 and the guide 219 approximate the configuration of a dowel.

Figure 37:
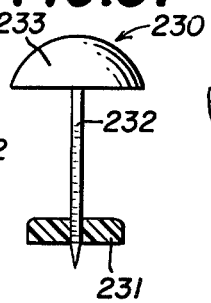
FIGS. 37 and 38 are views of still another form of the invention.
Figure 38:
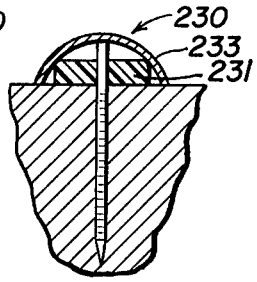

The nail 230 shown in FIGS. 37 and 38 also has a guide 231 fastened to the shank 232 thereof. The head 233 of the nail 230 has a hollow internal dome as shown in FIG. 38, and the guide 231 is sized to be received in the hollow dome of the head. The guide 231 serves the same function as the guide 219 and it has the advantage that it does not have to be used in a nail hole having a large opening such as the opening 223. However, where a large opening is not present, the head of the nail must be hollow. The principal of using a projection such as the projection 202 shown in FIGS. 32 and 33, may also be used to tuck the guide 231 into the domed head 233.

In FIGS. 35 to 38, the guides have diameters which are substantially equal to that of the nail heads, but in some designs it may be advantageous to have the diameter of the guide somewhat smaller or larger than the diameter of the nail head. In such an event the guide would have to be located along the length of the nail shank such that the nail head and the guide would slide along the feed tube and the muzzle but the end of the shank would not be able to tilt enough to gouge into the side of the feed tube or the muzzle. Any tilting of the nail could be taken care of by providing a large conically shaped opening as shown in FIG. 25, for example. Such an arrangement would be advantageous in any instance where the nail head has a relatively large diameter in relation to the diameter of the shank of the nail, because it is this type of nail which, without a guide, is able to tilt far enough to damage a feed tube or tool muzzle.

Another alternate design to those shown in FIGS. 35 to 38 consists of a guide designed to be fastened to a nail shank and to function similarly to the guides 219 and 231 except that it would be displaced, while driving the nail, to a position between the nail head and the surface of an article being nailed. Such a guide could be aesthetically complementary to the nail head and the surface, similarly to the spacer 111 shown in FIG. 20.

The large nail receiving openings, such as the opening 159, may be formed in a joining portion or in a decorative portion of a unit, or it may be formed in the surface of an article. The nails shown in FIGS. 35 to 38 may or may not be used with a trim unit.

It will be apparent from the foregoing that novel and useful forms of trim units and nails have been provided. A plurality of such identical trim units may be formed in an attractive design and attached to an article. Of course, not all of the units of a particular design need to be identical, so long as the joining portions of adjacent units have complementary or mating joining portions. The decorative portions of the joined units may vary in size or dimension as well as in design, color or shape. Further, it is not necessary that the units are attached or secured to an article to be decorated by the use of nails as shown in FIG. 2. The units may be attached to an article by pinnails having an almost invisible head, in which case the nail holes illustrated in the drawings need not be provided. Pinnails could be used where the unit is made of a hard material such as metal and nails of any kind would not normally be used when the article to which the design is to be attached, is made of a hard material such as a ceramic material. Of course, the units may also be fastened to an article using a suitable adhesive.

When using units of the type shown in FIGS. 13 and 14, for example, where the units may be snapped together, a complete design may be assembled and then attached to an article. Such a design may include a crossover unit as shown in FIG. 16, a larger core unit or a unit having a Tee type of design.

Where the units are to be used with nails driven by a power tool, the surface of the trim may be designed, by means of a protrusion or some other means, to guide the positioning of the muzzle of the power tool such that the nailhole and the driving axis of the nail are placed in proper alignment. Sucn an arrangement may be provided on any of the disclosed trim units having one or more nailholbs or nailing positions.

Where the terms "complementary to" and "mating with" are used herein, it is meant that the joining portion of one unit may be connected to a joining portion of another unit. It means that one joining portion is the reciprocal or the counter-part of another portion. It is not necessary, however, that the two units be identical. The joining portion at one end of a unit will normally have a shape which is substantially complementary to the joining portion at the other end of the unit as shown in FIG. 2 and in a number of other figures of the drawings, but of course such an arrangement is not necessary in some designs. For example, the joining portions may be made of a very thin material and be formed in essentially the same plane, but due to the thinness of the material, the joining portions at the ends of a unit will be substantially complementary to each other.

The form of the invention shown in FIGS. 1 and 2 is the preferred form when the units are made of metal. The form shown in FIGS. 25 and 26 is preferred when the units are made of plastic.

As previously mentioned, the general object of this invention is to provide trim units for use with decorative nails or with other fastening means to form a decorative design. Other modifications and variations of the trim units may be effected without departing from the scope of the novel concepts of the present invention, and it will be understood that the application is to be limited only by the scope of the appended claims. As an example of another modification, a unit could be provided having only a single preformed nail hole, which may have a slanted side wall. In the unit shown in FIG. 19, for example, the center portion 105 may be made flat instead of domed as shown, and a nailhole may be preformed at the center thereof.

Where the nature of the trim unit material permits, a nail could be driven into the flat center portion 105 (FIG. 19) without a preformed nailhole, or with a simple positioning or starting indentation, but normally the material would be of such a nature that a preformed nailhole would be provided.

While the trim units have been described as having a decorative function, they may also of course have a structural function or simultaneously have structural and decorative functions. They may be used to cover a seam or to hold an edge of upholstery material or fabric, and in these or similar functions they may be used to reduce the quantity of expensive nails otherwise required. They may also be used to assist in driving nails by a power tool because they may be designed to straighten out a tilted nail. They also help to correct or straighten out the shank of a deformed nail having a shank which is not perpendicular to the head.

I claim:

1. A decorative modular furniture trim unit adapted to be combined with a plurality of other trim units to form a composite decorative design of a size for attachment to a surface of an article such as upholstered furniture, cabinets and wall panels and attachable with nails having decorative heads to such an article said trim unit comprising two joining portions and a decorative portion extending between and connecting said joining portions, each of said joining portions being shaped to mate with and be substantially complementary to the other of said joining portions of said unit and to joining portions of other units, said joining portions and said decorative portion having a normally hidden underside which engages the article when in use, said decorative portion further including a normally viewed top side having a decorative design and being optionally variable relative to said other units in respect to size and design, said trim units being adapted to be joined with said plurality of other trim units and with the mating and complementary joining portions in engagement, and said decorative portions cooperating with said decorative heads of said nails to form said composite decorative design.

2. A unit as in claim 1, wherein one of said joining portions is interengageable with the other of said joining portions.

3. A unit as in claim 1, wherein said unit includes at least three of said joining portions and is adapted to serve as a core or crossover unit in a plurality of series of linearly joined units.

4. A unit as in claim 1, and further including a preformed nailhole formed in said unit.

5. A unit as in claim 4, wherein the sides of said preformed nailhole are slanted to guide a nail being driven.

6. A unit as in claim 1, wherein said joining portions have nailholes preformed therein which are adapted to receive said nails.

7. A unit as in claim 3, wherein the joining portions interengage.

8. A unit as in claim 6, wherein the sides of the nailholes are slanted to guide a nail being driven.

9. A unit as in claim 6, wherein the joining portions include orientation means.

10. A unit as in claim 6, wherein each of said joining portions includes means adjacent the nailholes for locating and aligning the muzzle of a nail driving power tool.

11. A unit as in claim 10, wherein said muzzle locating means consists of a protrusion adjacent the nailhole.

12. A decorative modular furniture trim unit adapted to be combined with a plurality of other trim units to form a composite decorative design of a size for attachment to a surface of an article such as upholstered furniture, cabinets and wall panels and attachable with nails having decorative heads to such an article, said trim unit comprising two joining portions and a decorative portion extending between and connecting said joining portions, each of said joining portions being shaped to mate with and be substantially complementary to the other of said joining portions of said unit and to joining portions of other units, said joining portions and said decorative portion having a normally hidden underside which engages the article when in use, said decorative portion further including a normally viewed top side having a decorative design and being optionally variable ralative to said other units in respect to size and design, said unit being bendable to substantially conform to the shape of the article being decorated, said trim units being adatped to be joined with said plurality of other trim units and with the mating and complementary joining portions in engagement, and said decorative portions cooperating with said decorative heads of said nails to form said composite decorative design.

13. A unit as in claim 12, wherein one of said joining portions is interengageable with the other of said joining portions.

14. A unit as in claim 10, wherein said unit includes at least three of said joining portions and is adapted to serve as a core or crossover unit in a plurality of series of linearly joined units.

15. A unit as in claim 12, wherein said joining portions have nailholes preformed therein which are adapted to receive said nails.

16. A unit as in claim 15, wherein said joining portions include orientation means.

17. A unit as in claim 15, wherein the joining portions interengage.

18. A unit as in claim 15, wherein the sides of the nailholes are slanted to guide a nail being driven.

19. A unit as in claim 18, wherein each of said joining portions includes means adjacent the nailholes for locating and aligning the muzzle of a nail driving power tool.

20. A unit as in claim 19, wherein said muzzle locating means consists of a protrusion adjacent the nailhole.

* * * * *